US006110193A

United States Patent [19]

Chen

[11] Patent Number: 6,110,193

[45] Date of Patent: Aug. 29, 2000

[54] MEDICINE DISPENSER CARRIED ON PACIFIER

[76] Inventor: Chean-Shui Chen, No. 33, Alley 16, Lane 313, Hsi-An Street, Sec. 1, Pei-tou, Taipei, Taiwan

[21] Appl. No.: 09/228,587

[22] Filed: Jan. 11, 1999

[51] Int. Cl.[7] ..... A61J 17/00

[52] U.S. Cl. ..... 606/234; 604/77

[58] Field of Search ..... 606/234, 235, 606/236; 604/77, 73; 215/11.1, 11.3, 11.4

[56] References Cited

U.S. PATENT DOCUMENTS 5,123,915 6/1992 Miller et al. ..... 604/77
5,620,462 4/1997 Valenti ..... 606/234
5,662,684 9/1997 Caso ..... 606/234
5,843,030 12/1998 Van Der Merwe ..... 606/236

*Primary Examiner*—Michael H. Thaler
*Assistant Examiner*—Kevin Truong

[57] ABSTRACT

A medicine dispenser carried on pacifier includes: a miniature container adapted for filling medicine therein, and a pacifier combinable with the miniature container and fluidically communicated with the interior in the container, whereby upon sucking by a baby or an infant on a nipple portion of the pacifier, the medicine as flowing from the container into a passage in the nipple portion of the pacifier, the medicine will be sucked and administered into a baby's mouth through the passage in the nipple portion for treating or curing a baby's disease.

5 Claims, 4 Drawing Sheets

MEDICINE DISPENSER CARRIED ON PACIFIER

BACKGROUND OF THE INVENTION

U.S. Pat. No. 5,383,906 to Mark T. Burchett disclosed an integrated nursing bottle and liquid medication dispensing apparatus having a syringe coaxially mounted within a baby bottle for administration of the medication from the syringe into a baby's mouth as diluted by the liquid in the nursing bottle. However, such a conventional nursing bottle has the following drawbacks:

1. The nursing bottle will become heavy when filled with liquid in the bottle, which will be difficultly carried by baby's small hands.
2. The syringe should be operated by a nurse or a mother, unable to be directly operated by a baby.
3. The liquid as suddenly boosted and sprayed by the syringe piston may possibly cause suffocation of a baby nasal passage or throat portion.

The present inventor has found the drawbacks of the conventional nursing bottle and invented the present medicine dispenser carried on pacifier.

SUMMARY OF THE INVENTION

The object of the present invention is to provide a medicine dispenser carried on pacifier including: a miniature container adapted for filling medicine therein, and a pacifier combinable with the miniature container and fluidically communicated with the interior in the container, whereby upon sucking by a baby or an infant on a nipple portion of the pacifier, the medicine as flowing from the container into a passage in the nipple portion of the pacifier, the medicine will be sucked and administered into a baby's mouth through the passage in the nipple portion for treating or curing a baby's disease.

DETAILED DESCRIPTION

As shown in FIGS. 1~4, the present invention comprises: a miniature container 1 for filling medicine M therein, and a pacifier 2 combinable with and capped on the miniature container 1.

The materials for making the present invention may be selected from plastic or rubber materials preferably with transparent or translucent materials, but not limited in the present invention.

The volume within the container 1 may range from 2~15 cc., but not limited in the present invention.

Figure 5:
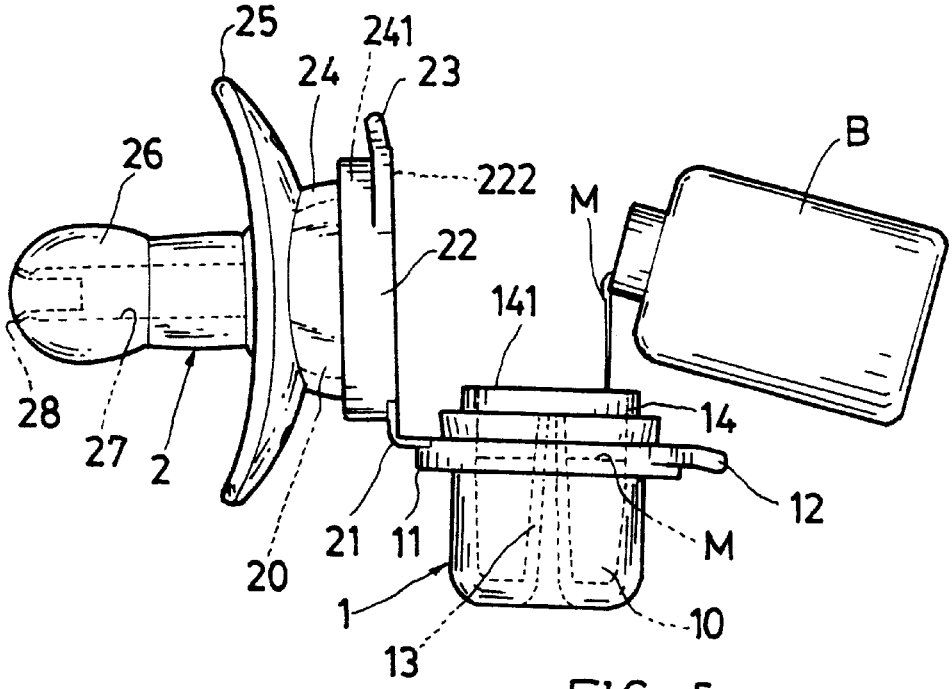
FIG. 5 is an illustration when filling medicine into the miniature container of the present invention.
Figure 8:
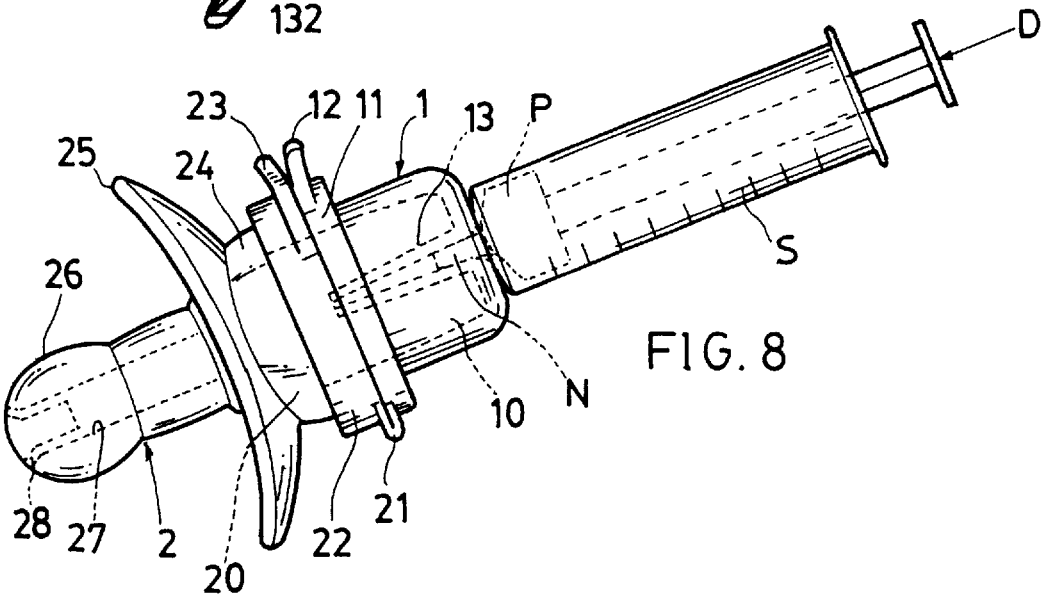
FIG. 8 is an illustration of the present invention when applying medicine into the container and pacifier by syringe injection.

The miniature container 1 includes: a container interior 10 defined within the container 1 for directly filling medicine M therein such as decanted from a medicine bottle B as shown in FIG. 5 or as injected by a syringe S as shown in FIG. 8, a flange 11 circumferentially formed on an upper periphery of the container to be combinable with the pacifier 2 and having a container handle 12 which may be a tab protruding outwardly radially from the flange 11, a hollow tube 13 protruding from a bottom 111 of the container 1 towards a container opening 141 adapted for connecting a needle sleeve N of the syringe S as shown in FIG. 8 for filling medicine into the interior 10 through the hollow tube 13 as injected from the syringe S, and a rim extension 14 annularly formed on an opening edge portion of the container opening 141.

The hollow tube 13 includes a bottom inlet 131 formed through the bottom 111 of the container 1, and an outlet 132 formed on a tapered tube end portion of the tube 13 adjacent to the container opening 141.

Figure 6:
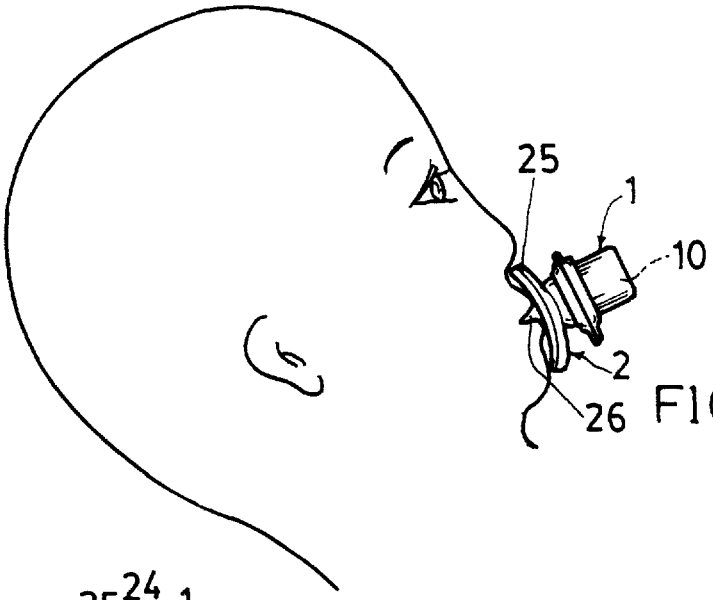
FIG. 6 is an illustration showing a suction and administration of medicine by a baby in accordance with the present invention.

The pacifier 2 includes: a hinge portion 21 formed on a coupling ring 22 and integrally connected with the flange 11 of the miniature container 1, a cap portion 24 having a cap periphery 241 having a cross section generally L shaped with a cap groove 242 recessed in the cap periphery 241 to be engageable with an annular extension 221 of the coupling ring 22, an annular groove 222 annularly recessed in the coupling ring 22 adjacent to the cap periphery 241 and having a cross section generally L shaped and engageable with the rim extension 14 of the miniature container 1 for engageably capping the coupling ring 22 and the cap portion 24 of the pacifier 2 on the rim extension 14 and the flange 11 of the miniature container 1, a cap handle 23 protruding outwardly radially from the coupling ring 22 adapted for closing the pacifier 2 with the container 1 by cooperatively closely clamping the container handle 12 with the cap handle 23 (FIG. 3) for combining the pacifier 2 with the miniature container 1, a skirt portion 25 radially protruding outwardly from the cap portion 24 with the cap portion 24 diverging outwardly from the skirt portion 25 towards the coupling ring 22 of the pacifier 2 and defining a cap interior 20 within the cap portion 24 and communicated with the container interior 10 when combining the pacifier 2 with the container 1, and a nipple portion 26 protruding from the skirt portion 25 in a direction opposite to the cap portion 24 to be sucked by a baby as shown in FIG. 6.

The cap handle 23 of the pacifier 2 is formed with a finger notch 231 in the cap handle 23, allowing holding on the container handle 12 by a finger through the finger notch 231 for opening the pacifier 2 from the container 1 by biasing and separating the container handle 12 from the cap handle 23.

The nipple portion 26 is formed with a longitudinal passage 27 in the nipple portion 26 and communicated with the cap interior 20 in the pacifier 2, and two bifurcated openings 28 bifurcated from the longitudinal passage 27 and formed through the nipple portion 26 for directing the medicine M outwardly into two streamflows through the two bifurcated openings 28 in the nipple portion 26 to prevent from suffocation of a baby as caused by a sudden suction of excess medicine amount into a baby's nasal passage and throat portion. The two bifurcated openings 28 are diverged outwardly from the longitudinal passage 27 in the nipple portion 26 of the pacifier 2. Each opening 28 may be formed with a convex portion 281 adjacent to an exit of the opening 28 to serve as a buffer for preventing a rapid outward suction of medicine liquid from the interior in the pacifier and container.

By decanting medicine M from a bottle B (FIG. 5) into the container; or by injecting medicine into the hollow tube 13 of the present invention by a syringe S when inwardly depressing (D) the piston P in the syringe (FIG. 8), the pacifier 2, when combined and closed on the container 1, may be sucked by a baby (FIG. 6) to administer medicine M from the interior in the pacifier 2 and the container 1. The air may enter the container 1 and pacifier 2 through the hollow tube 13 to prevent from occurring of vacuum in the pacifier in order for a smooth suction of medicine.

Figure 7:
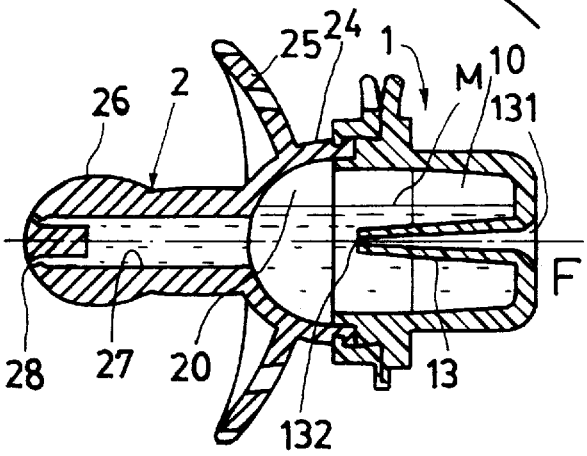
FIG. 7 is a sectional drawing showing the flowing of medicine in the present invention when tilted or horizontally positioned.

Since the outlet 132 of the hollow tube 13 is tapered from the tube 13 to minimize its diameter exerting a surface tension on the outlet port of the tube 13, the medicine M already filled within the container 1 and the pacifier 1 will thus not overflow, backflow or discharge outwardly through the hollow tube 13 even the present invention is tilted or horizontally positioned as shown in FIG. 7, thereby preventing from any loss of medicine once filled in the container and pacifier of the present invention.

Figure 3:
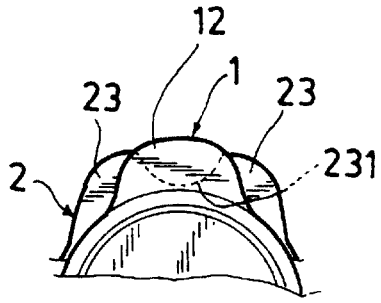
FIG. 3 shows a relationship of a container handle with a cap handle of the pacifier as viewed from 3—3 direction of FIG. 2.
Figure 2:
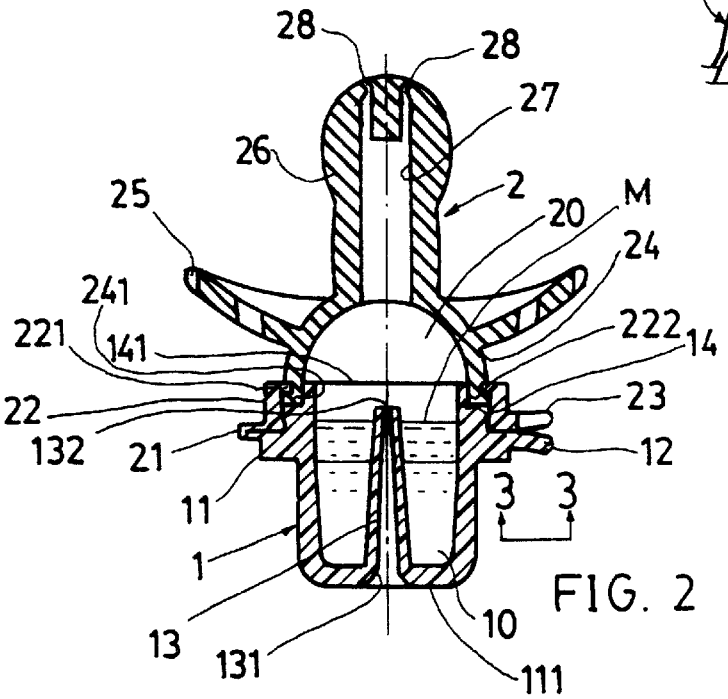
FIG. 2 is a sectional drawing of the present invention when the pacifier is combinable with and capped on the miniature container.
Figure 4:
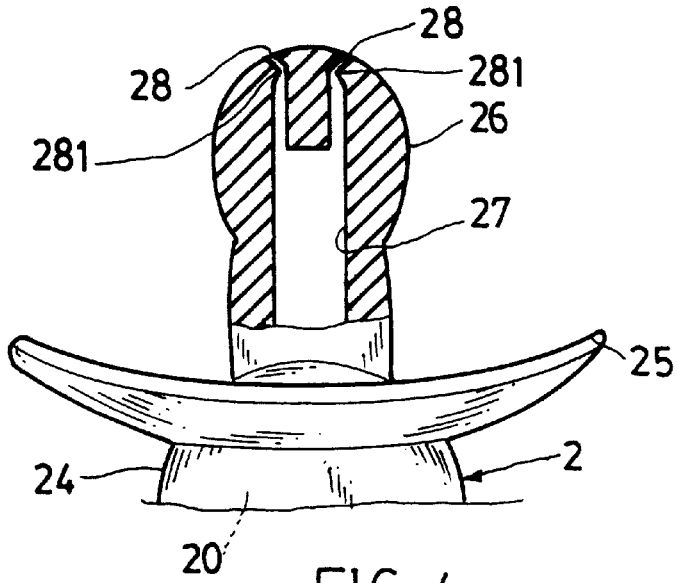
FIG. 4 is a partial sectional drawing showing the longitudinal passage and two bifurcated openings in the nipple portion of the pacifier.

The cap handle 23 and the container handle 12 may help close or open the two parts, namely the pacifier 2 and the container 1, of the present invention. For instance, by pressing the two handles 12, 23 together as shown in FIGS. 3, 2, the rim extension 14 of the container 1 will be engaged with the annular groove 222 and the cap portion 24 in the pacifier 2 for combining the container 1 with the pacifier 2 to "confine" the medicine within the present invention in order to be sucked and administered by a baby.

The present invention is superior to the prior art such as U.S. Pat. No. 5,383,906 with the following advantages:

1. The miniature container 1 is a small container filled with little volume of medicine and will not cause a heavy weight for the pacifier, thereby being easy to be sucked and administered by a baby.
2. Even the container 1 is integrally securable with the pacifier 2, the container 1 may be separable from the pacifier 2 for a convenient filling of medicine in the container.
3. The present invention can be voluntarily sucked by a baby or infant without the aid of a nurse or mother.
4. The medicine is gradually sucked into a baby mouth, not by a sudden injection by an adult (such as an inadvertent nurse), thereby preventing from suffocation of a baby and ensuring a safety baby-care accordingly.

The present invention may be modified without departing from spirit and scope of the present invention.

Figure 1:
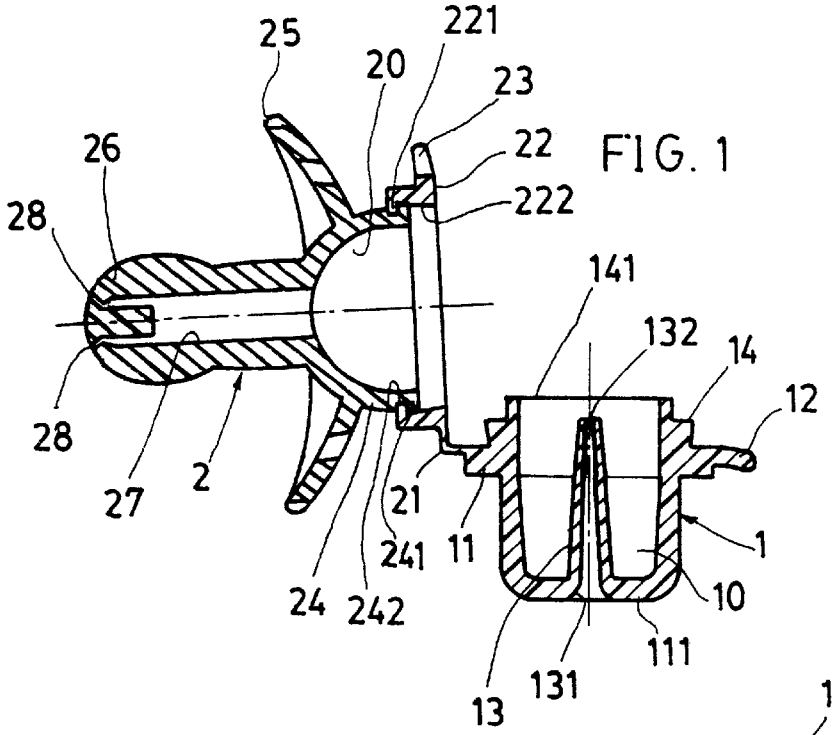
FIG. 1 is an illustration of the present invention showing the pacifier openable from the miniature container.
Figure 9:
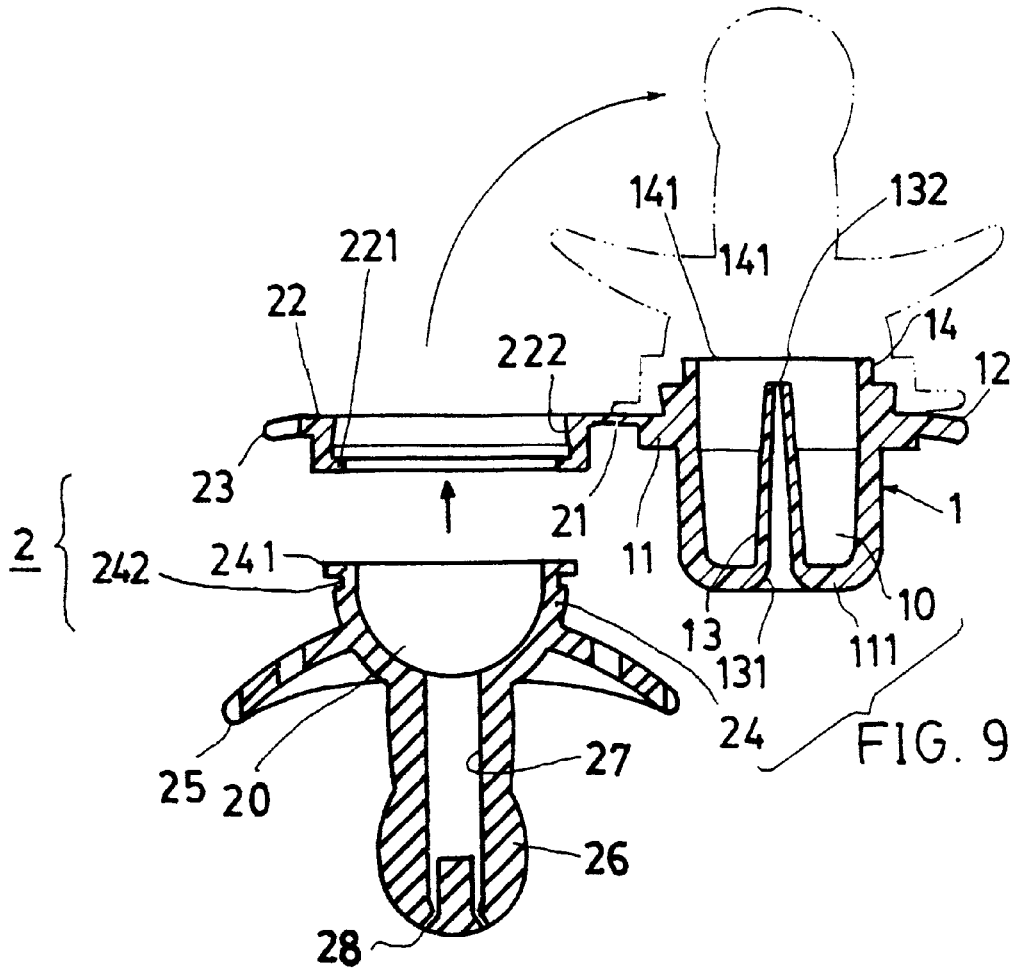
FIG. 9 shows an assembly for forming the present invention.

As shown in FIG. 9, a production or assembly of the invention is shown, in which the coupling ring 22 is integrally secured to the flange 11 of the container 1 through the hinge 21; and the cap groove 242 of the pacifier 2 is engaged with the extension 221 of the coupling ring 22 hingedly connected to the container 1 to allow the pacifier 2 to be integrally securable with the container 1 as shown in FIG. 1.

Figure 10:
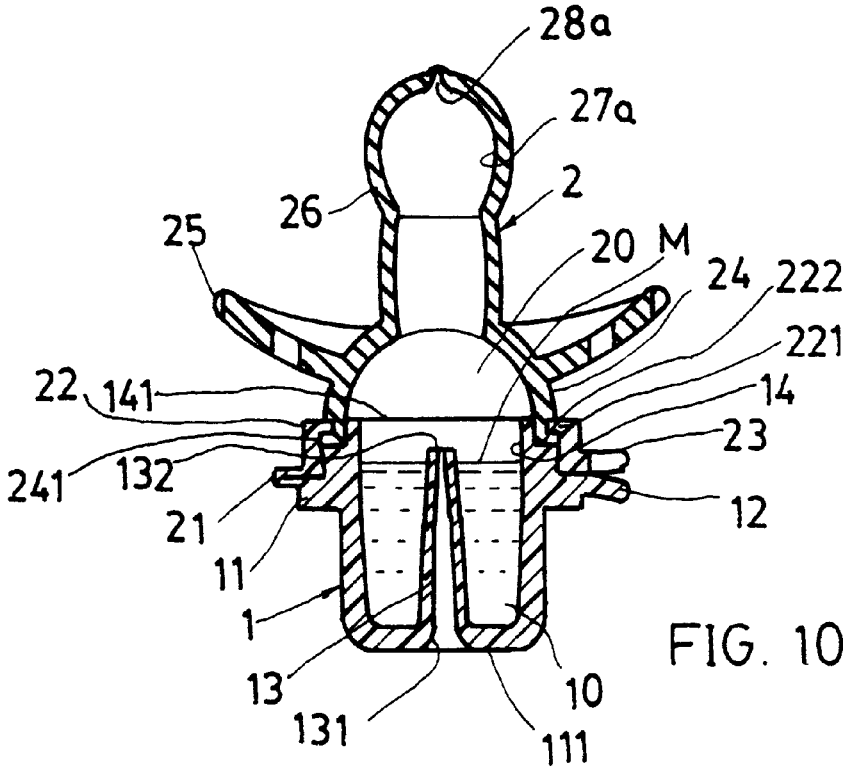
FIG. 10 shows another preferred pacifier of the present invention.

As shown in FIG. 10, the pacifier 2 may also be formed with a single opening 28*a* communicated with the nipple interior 27*a* within the nipple portion 26 of the pacifier 2.

What is claimed is:

1. A medicine dispenser carried on pacifier comprising:

a miniature container adapted for filling medicine therein; and a pacifier integrally securable with and openable from said miniature container, and said pacifier combinable with and capped on said miniature container for confining the medicine as filled into the container within the container and the pacifier;

said miniature container includes: a container interior defined within the container for directly filling medicine therein, a flange circumferentially formed on a periphery of the container to be combinable with the pacifier having a container handle protruding outwardly radially from the flange, a hollow tube protruding from a bottom of the container towards a container opening adapted for connecting a needle sleeve of a syringe for filling medicine into the interior through the hollow tube as injected from the syringe, and a rim extension annularly formed on an opening edge portion of the container opening.

2. A medicine dispenser carried on pacifier according to claim 1, wherein said hollow tube includes a bottom inlet formed through the bottom of the container, and an outlet formed on a tapered tube end portion of the tube a adjacent to the container opening.

3. A medicine dispenser carried on pacifier according to claim 1, wherein said pacifier includes: a hinge portion formed on a coupling ring and integrally connected with the flange of the miniature container, a cap portion having a cap periphery and a cap groove recessed in said cap periphery to be engageable with an annular extension of the coupling ring, an annular groove annularly resessed in the coupling ring and engageable with the rim extension of the miniature container for engageable capping the coupling ring and the cap portion of the pacifier on the rim extension and the flange of the miniature container, a cap handle protruding outwardly radially from the coupling ring adapted for closing the pacifier with the container by cooperatively closely clamping the container handle with the cap handle for combining the pacifier with the miniature container, a skirt portion radially protruding outwardly form the cap portion with the cap portion diverging outwardly towards the coupling ring of the pacifier and defining a cap interior within the cap portion with the cap interior communicated with the container interior when combining the pacifier with the container, and a nipple portion protruding from the skirt portion in a direction opposite to the cap portion to be sucked by a baby.

4. A medicine dispenser carried on pacifier according to claim 3, wherein said cap handle of the pacifier is formed with a finger notch in the cap handle, allowing a holding on the container handle by a finger through the finger notch for opening the pacifier from the container by biasing and separating the container handle from the cap handle.

5. A medicine dispenser carried on pacifier according to claim 3, wherein said nipple portion is formed with a longitudinal passage in the nipple portion and communicated with the cap interior in the pacifier, and two bifurcated openings bifurcated from the longitudinal passage and formed through the nipple portion for directing medicine outwardly into two streamflows through the two bifurcated openings in the nipple portion to prevent from suffocation of a baby as caused by a sudden suction of excess medicine amount into a baby's nasal passage and throat portion; with said two bifurcated openings diverged outwardly from the longitudinal passage in the nipple portion of the pacifier; and each said opening in said nipple portion laving at least a convex portion formed on an inside wall of the opening for a buffer to prevent from a rapid suction of medicine from the nipple portion.

* * * * *